US006224974B1

(12) United States Patent
Wuu

(10) Patent No.: US 6,224,974 B1
(45) Date of Patent: May 1, 2001

(54) WATER RESISTANT, CAUSTICALLY REMOVABLE COATING, PAPER LABEL AND RECYCLABLE LABELED GLASS BOTTLE

(75) Inventor: Fuushern Wuu, Wisconsin Rapids, WI (US)

(73) Assignee: Consolidated Papers, Inc., Wisconsin Rapids, WI (US)

( * ) Notice: Subject to any disclaimer, the term of this patent is extended or adjusted under 35 U.S.C. 154(b) by 0 days.

(21) Appl. No.: 09/266,059

(22) Filed: Mar. 10, 1999

(51) Int. Cl.[7] ..... B32B 7/12

(52) U.S. Cl. ..... 428/343; 428/346; 428/349; 428/351; 428/355

(58) Field of Search ..... 428/343, 346, 428/349, 351, 355

(56) References Cited

U.S. PATENT DOCUMENTS

| | | | |
|---|---|---|---|
| 3,946,750 | 3/1976 | Fischer et al. | 134/104 |
| 4,103,698 | 8/1978 | Richardson et al. | 134/73 |
| 4,108,774 | 8/1978 | Babunovic et al. | 210/167 |
| 4,176,067 | 11/1979 | Vamvakas | 210/256 |
| 4,185,647 | 1/1980 | Babunovic | 134/60 |
| 4,258,104 | 3/1981 | Lee et al. | 428/342 |
| 4,278,727 | 7/1981 | Brabetz et al. | 428/290 |
| 4,325,775 | 4/1982 | Moeller | 156/584 |
| 4,340,638 | 7/1982 | Brugmans | 428/323 |
| 4,349,402 | 9/1982 | Parker | 136/233 |
| 4,434,259 | 2/1984 | Gold et al. | 524/31 |
| 4,594,111 | 6/1986 | Coonan | 134/3 |
| 4,661,152 | 4/1987 | Kimura et al. | 75/76 |
| 4,964,939 | 10/1990 | Gleason | 156/336 |
| 5,330,581 | 7/1994 | Syrinek | 134/22.17 |
| 5,654,039 * | 8/1997 | Wenzel et al. | 427/391 |

FOREIGN PATENT DOCUMENTS

| | | |
|---|---|---|
| 3607720 C2 | 1/1990 | (DE) . |
| 0 078 918 | 5/1983 | (EP) . |
| 52-14634 | 2/1977 | (JP) . |
| 6-17018 | 1/1994 | (JP) . |

* cited by examiner

*Primary Examiner*—Yogendra Gupta
*Assistant Examiner*—Charles Boyer

(57) ABSTRACT

A water resistant, caustically removable coating and method for making the same is disclosed. The coating is utilized to make a paper label which is water resistant but can be repulped in conventional caustic bottle washing solution. The coated paper label is applied to a bottle, the bottle used and then recycled using conventional caustic bottle washing solution to remove and repulp the paper label, permitting recycling of the bottle, and if desired, making paper from the recovered pulp.

12 Claims, 1 Drawing Sheet

WATER RESISTANT, CAUSTICALLY REMOVABLE COATING, PAPER LABEL AND RECYCLABLE LABELED GLASS BOTTLE

DISCLOSURE

This invention relates to coatings and to recyclable paper labels for glass bottles or the like, and more particularly to paper labels and coating for such paper labels to impart water repellence to, while still permitting recycling of, the same.

BACKGROUND OF THE INVENTION

It has long been known to recycle glass bottles or the like carrying paper labels with a caustic bottle washing solution. For example, see U.S. patent application Ser. No. 08/290,626, referred to in U.S. Pat. No. 5,654,039. Also the following:

| U.S. Patents | |
|---|---|
| 3,946,750 | 4,340,638 |
| 4,103,698 | 4,349,402 |
| 4,108,774 | 4,434,259 |
| 4,176,067 | 4,594,111 |
| 4,185,647 | 4,661,152 |
| 4,258,104 | 4,964,939 |
| 4,278,727 | 5,330,581 |
| 4,325,775 | |
| German Patent DE 3607720 C2 | |
| Japanese Patent 52-14634 | |
| 6-17018 | |
| European Patent 0 078 918 | |

Some, but not all, of the approaches used in the prior art taught providing a metalized label, such as made at least in part of aluminum or other metallic material that was attacked or dissolved by the caustic bottle washing solution (for example, 3% NaOH in water). When the aluminum or metal was attacked, the label was caused to essentially disintegrate.

The label is attached to the bottle or other object with an adhesive that dissolved in the caustic bottle washing solution. Due to the speeds at which commercial bottle recycling or washing occurs, it is necessary that the labels be removed from the glass or bottles in but a few, say about 3 or 4 minutes. Any longer delay would slow down existing processes and/or require an expensive equipment process redesign. When this type label and adhesive were attacked by the caustic solution, in effect the whole or integral label was freed from the bottle. The labels and bottles are then separated, the labels generally being collected integral or whole, and then had to be separated out of the washing solution.

The former method was not usable with labels made of materials not attacked by caustic solution, and the latter approach required the separate step of collecting the freed labels from the washing solution.

Additionally, many times it is desired to have a label without a metalized appearance.

Further in addition to recyclability, it is desired that the labeled bottled or the like, have a certain degree of water repellence or water resistance. This property is desired as many times in taking a labeled bottle or the like from the bottler or manufacturer to its point of sale and/or use, it may be exposed to water, rain, frost, snow, fog, high humidity or a high moisture environment, or the like, and the label must retain an attractive appearance throughout its manufacture-use cycle despite such conditions.

SUMMARY OF THE INVENTION

The present invention provided a paper label and method for making the same of paper that need not be metalized or contain any metallic powder in order to be recyclable in the usually caustic bottle washing solutions, retains a good appearance when exposed to the various forms of moisture mentioned above throughout its life cycle, yet permits the label of the present invention to be readily removed and the removed label paper repulped and, if desired, reused to manufacture some type of paper product, such as tissue, writing and printing papers, label paper, etc. The label of the present invention comprises a pulpable label paper base (preferably free sheet—without mechanical pulp) to which is applied, as by a coating process, at least one water resistant but yet caustic dissolvable coating. Preferably, this coating is the first down and applied to the top side of the label paper base or web. The coating applied to the label base paper may also include a water repelling agent (preferably alkyl ketene dimer "AKD"), in weight of 2% to 4% of the total weight of the coating pigment. Preferably, such a coating comprises: a caustic soluble resin or polymer, for example an acrylic polymer (for example, Rhoplex I-2350), in weight of 8% to 25% of the total weight of the coating pigment (or 40% to 100% of binder). Though not necessary, a caustic soluble pigment, for example aluminum trihydrate, (sold under brand name Hydra-coat-5 made by Alcoa) in weight of 15% to 35% of the total weight of the coating pigment could be used.

No metal powder need to be used, nor need there be a deposited metal layer so that it is possible to produce a label without a metallic appearance. Of course, if a metallic appearance is desired, the present invention could also be utilized with metallics.

The present invention has the advantages of dispensing with the need for any metallic deposition process, should that be desired, provides a way to avoid a metallic surface or appearance, if desired, and does not use neat resin coatings.

OBJECTS OF THE INVENTION

One object of the present invention is to provide a method for making a paper label which can be applied to and then later removed from a glass object in a caustic washing solution.

Another object of the present invention is to provide a coating for use on a paper label which can be applied to and then later removed from a glass object in a caustic washing solution.

Yet another object of the present invention is to provide a paper label which can be applied to and then later removed from a glass object in a caustic washing solution.

Still another object of the present invention is to provide a paper labeled glass object which can be de-labeled and the paper repulped in the caustic washing solution process.

A further objection of the present invention is to provide a method, coating, paper label and labeled object with good water repellency, but yet permit removal of the paper label from the object in a caustic washing solution.

These and yet other objects will become apparent from the foregoing and the following written description, accompanying drawings and claims.

DESCRIPTION OF THE PREFERRED EMBODIMENTS

Figure 1:
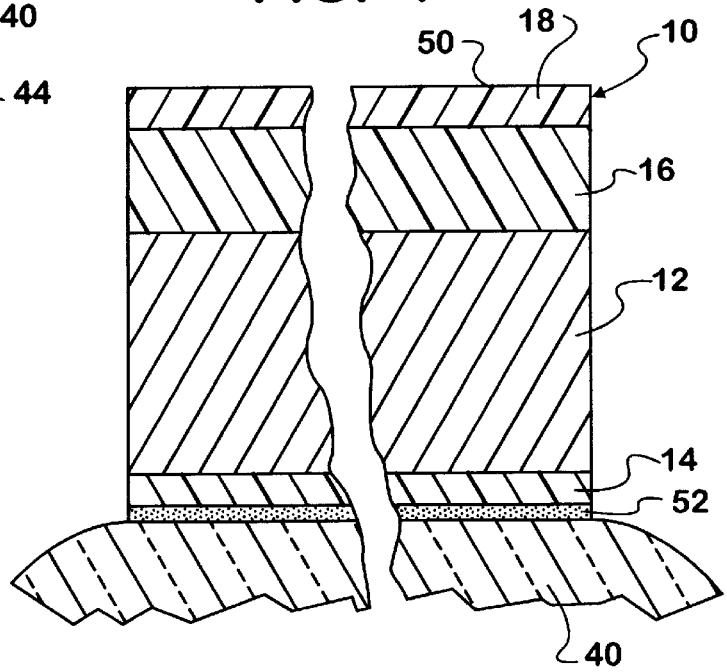
FIG. 1 is a schematic cross-sectional view of a preferred embodiment of a paper label of and made by the present invention.

Referring to FIG. 1, preferably the coated paper product 10 of the present invention comprises a paper base sheet 12, of any desired weight, with say 18 to 60 pounds per ream being suitable, and 28.5 to ±2.0 pounds being preferred. A suitable paper stock can be of various types with MG (machine glazed) being suitable. Preferably, the base stock is free sheet, that is, without mechanical pulp, so that if repulped, it has a wide variety of uses. The function of the base sheet 12 is to provide physical integrity, support and carry the coating(s) described below, and provide brightness and opacity. In the present invention the paper base makes up at least 70% by weight of the label.

On the backside of the base sheet, a backside coating 14, if used, may be applied to a weight of say less than 1 to 10 pounds per ream, with a weight of about 2.5±0.5 pounds per ream being preferred. The function of the backside coating is to seal up and smooth the backside of the base paper surface, to provide a non-reactive, gluable surface, and to enhance brightness, opacity and paper strength of the base sheet. This backside coating can be of any suitable known or future developed coating formulation. While a backside coating of from 40% to 65% solids would be suitable, a backside coating of about 45% solids is preferred. Of course, as the backside coating is optional, it can be omitted.

A suitable backside coating recipe comprises:

1. pigment or pigments including one or more of: clay(s), calcium carbonate(s), titanium dioxide(s), plastic pigments, talc, aluminum trihydrate, and other pigments;
2. adhesive(s)/binder(s) including one or more of: starch, protein, PVOH (polyvinylalcohol) and other binders; latexes and others;
3. water repelling agent(s) including one or more of: wax emulsion, AKD emulsions, SMA (styrene maleic anhydride polymers and others;
4. dispersant(s) including one or more of: polyphosphates, polyacrylates and others;
5. temporary wet strength agent(s) including one or more of: dialdehyde starch, glyoxalated polyacrylamide, glyoxal and others; and
6. lubricant(s) including one or more of: stearates, polyglycol esters and others;

and can be made in any conventional manner, such as, for example, the one shown below.

The "make-down", recipe or formula for the backside coatings used with the present invention are as follows:

(a) Add water to the mixing vessel, then (b) Add dispersant (such as Dispex) then (c) Add slurred pigments (such as No. 2 clay, calcined clay, delaminated or other clays or the like), then (d) Add binders, (i.e., protein, resins, latexes, starches, etc.), then (e) Add dry pigments (if need to achieve coating solids level—sometimes no additional dry pigment is needed as the slurried pigments solids percent is sufficiently high), then (f) Add other ingredients desired (such as, if desired, a water repelling agent(s), temporary wet strength agent (s) and lubricants).

While the above recipe order works, it is understood that variations thereof are possible. For example, dispersant(s) can be added after pigment(s) and binder(s) if interaction of pigment(s) and binder(s) desired.

The coated paper 10 may include one or more top side coatings for example, in FIG. 1, two top side coatings 16 and 18 are shown. The coatings 16 and 18 are applied in sequence with coating 16 being applied before coating 18. Of course, more or fewer topside coatings could be used.

The topside and backside coatings could be applied in any order, but usually the topside coatings are applied first to the base sheet.

In this instance, the topside coating 16 is applied to a weight of say 2 to 7 pounds per ream, with a weight of about 4.5±0.5 pounds per ream being preferred. The function of this first down or topside coating 16 is to provide the caustic solubility, brightness, opacity, a smooth surface for the second topside coating and enhancement of the mechanical strength of the base paper. This topside coating 16 is of the type described below or its equivalent. While topside coating 16 of from 40% to 65% solids would be suitable, a first down topside coating of about 53% solids is preferred as the coating applying apparatus such as a short dwell time applicator (see U.S. Pat. No. 4,250,211 which is incorporated herein by reference) works well at such solids level.

A suitable first topside coating 16 recipe comprises:

11 parts Latex 8879 binder (or less) (made by Dow Chemicals)

11 parts Rhoplex I- 2350 (or greater up to 22 parts) binder (made by Rhom-Hass)

2 parts Procote 183Z protein binder (made by Protein Technology Inc.)

4 parts Hercon-70 water repellent or sizing agent (made by Hercules Inc.)

0.2 parts Dispex-40 (dispersant) (made by Bercen Inc.)

33 parts No. 2 Clay pigment 50 parts (or greater—with less other pigments) $TiO_2$ pigment in slurried or dry pigment form 17 parts (or greater—with less other pigments than $TiO_2$) Ansilex—a calcined clay pigment (made by Engelhard Corp.) in slurried or dry pigment form and can be made in any conventional manner, such as shown, for example below.

As the polyacrylic resins, and resins in general, such as, Rhoplex I- 2350 are comparatively more expensive than fibers, particularly paper, that formulation with lower ratios of resin and higher ratios of fibers, particularly paper, offer a significant cost advantage. The present invention has the further advantage of using commercially available components and elements that can be manufactured readily on existing paper machines and paper converting equipment.

The important ingredient in the first down topside coating 16 is the acrylic copolymer in the Rhoplex (I-2350). This type Rhoplex is 29%–31% acrylic copolymer, with the balance, not including traces being 69%–71% water. A particular advantage is that Rhoplex I-2350 is already Federal Drug Administration (FDA) approved for food related uses. It is believed at least 10 parts or greater Rhoplex binder is needed to make a good first down topside coating that is recyclable in caustic washing solution. In fact Rhoplex I-2350 as high as 22 parts could be used with an accompanying reduction in latex binder, i.e., use Rhoplex to replace all the latex. As noted above, the pigments can be in either slurried, dry or both forms. Thus, Rhoplex I- 2350 could comprise anywhere from 40% to 100% of the binder in the top coating.

In addition to the pigments listed above, it would be possible to also use plastic pigments, talc, or calcium carbonate to replace some or all of the No. 2 clay or Ansilex. In the first down topside coating one could use a wax emulsion instead as a water repelling agent. Likewise one could use a polyphosphate type dispersant instead, or a dialdehyde starch wet strength agent, or if desired though not essential, one or more of the previously or subsequently mentioned lubricants.

The specific recipe or "make-down" for the first down coating for the upper, in this instance (MG), side of the base sheet are as follows:

(a) Add water to the mixing vessel, then (b) Add dispersant, then (c) Add slurried pigments, if any, (i.e., No. 2 Clay, $TiO_2$, etc.) then (d) Add binders, i.e., latexes and/or protein, then (e) Add dry pigment, if any (i.e., calcined clay, $TiO_2$ clay, and other dry pigments), then (f) Add other ingredients, such as the AKD, water repelling agent(s), lubricant(s) and temporary wet strength agent(s), etc.

The mixing/agitation mechanism of the mixing vessel is utilized while mixing and adding the ingredients.

While the above recipe order works, it is understood that variations thereof are possible. For example, if interaction of pigment(s) and binder(s) is desired, then dispersant is added after the two are blended together. Also, it should be understood that other orders are also workable.

The second down topside coating 18 is applied to a weight of say 1.5 to 3.5 pounds per ream, with a weight of about 2.5±0.5 pounds per ream being preferred. The function of the second topside coating is to provide a smooth attractive printing surface, brightness, opacity and a suitable surface for finishing subsequent processes. This second topside coating can be of any suitable known or future developed coating. While second topside coating of from 10% to 65% solids would be suitable, a second topside coating of about 53% solids is preferred.

A suitable second topside coating recipe comprises:

1. pigment(s) including one or more of: clay(s), calcium carbonate(s), titanium dioxide(s), plastic pigment(s), talc, aluminum trihydrate and other pigments;
2. adhesive(s)/binder(s) including one or more of: starch, protein, PVOH, latexes and others;
3. water repelling agent(s) including one or more of: wax emulsion, AKD emulsions, SMA polymers and others;
4. dispersant(s) including one or more of: polyphosphates, polyacrylates, etc.
5. temporary wet strength agent(s) including one or more of: dialdehyde starch, glyoxalated polyacrylimide, glyoxal, etc; and
6. lubricant(s) including one or more of: stearates, polyglycol esters, etc.

The above recipe can be made in any conventional manner, such as, for example, the one shown below.

A suggested make-down for the second topside (MG) coating is as follows:

(a) Add water to the mixing vessel, then (b) Add slurried pigments, i.e., No. 1 clay and/or No. 2 clay, then (c) Add binders, i.e., latex and/or protein, then (d) Add other ingredients, if any, such as lubricant and strength resin(s).

Again, the above steps are carried out with mixing and agitation. Of course, other orders may be followed.

It should be noted that the label paper usually though not necessarily, will be subsequently supercalendered and/or hot-soft calendered after coating to add gloss to the coated web or finished web.

Referring to FIG. 1, it is apparent the paper base 12 will make up a substantial portion of the label. The first top coating 16 will be one-half or less the thickness of the base 12. The second top down coating 18, if present, will be one-half or less of the thickness of the first down top coating 16 (one quarter or less of the thickness of the base 12). The bottom coating 14, if present, will be one-half or less of the thickness of the first down top coating 16 (one quarter or less of the thickness of the base 12). The adhesive 52 is about one-half or less of the thickness of the top coating 16 (one quarter or less of the thickness of the base 12). It should also be noted that except for minor penetration at the interfaces, the coatings 16 and 14 are clearly separate from and distinct from the base paper 12.

The above preferred formulation which we can here call Sample III was part of a line of development which included earlier attempts to develop a non-metallic, caustically soluble label. In arriving at the preferred first down topside coating, two earlier formulations were developed to try to achieve the desired results. These two earlier developments were formulated and will be referred to as Sample I and Sample II and were generally as follows:

Sample I 22 parts Latex (8879)
2 parts Procote (183Z)
2 parts Hercon-70
0.2 parts Dispex-40
33 parts No. 2 Clay
50 parts $TiO_2$
17 parts Ansilex Sample II
22 parts Latex (8879)
2 parts Procote (183Z)
4 parts Hercon-70
0.2 parts Dispex-40
33 parts No. 2 Clay
50 parts $TiO_2$
17 parts Ansilex Samples I and II were made down in a manner similar to that described above for Sample III. A comparison of the three samples, the above Samples I and II and the preferred Sample III earlier described, shows the latter to be superior having good wet opacity and excellent caustic solubility. Caustic solubility was determined by putting coated label paper in a 3% caustic (NaOH) solution of 170–175° F. with agitation for three minutes. An excellent rating was given if the label is completely repulped within the three minutes time. A marginal rating meant there was still some piece of label paper remaining at the three minutes time.

TABLE 1

| | Sample I | Sample II | Preferred Sample III | Spec 574 | Spec 817 |
|---|---|---|---|---|---|
| Wet Opacity | 83.7 ± 0.6 (Excellent) | 85.2 ± 0.6 (Excellent) | 84.8 ± 0.6 (Excellent) | 58.3 | 63.7 |
| Caustic Solubility | Marginal | Not Acceptable | Excellent | Marginal | Marginal |
| Brightness | 86.91 | 86.93 | 86.94 | 83 | 80 |
| Dry Opacity | 89.25 | 89.25 | 89.43 | 88.5 | 86 |

Figure 3:
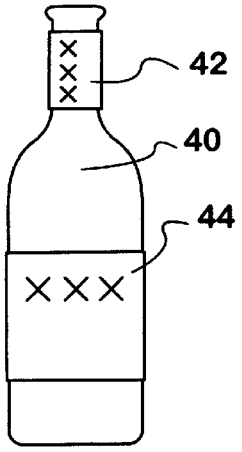
FIG. 3 is a schematic view showing application of the paper labels to a glass bottle both of which may later be recycled.
Figure 2:
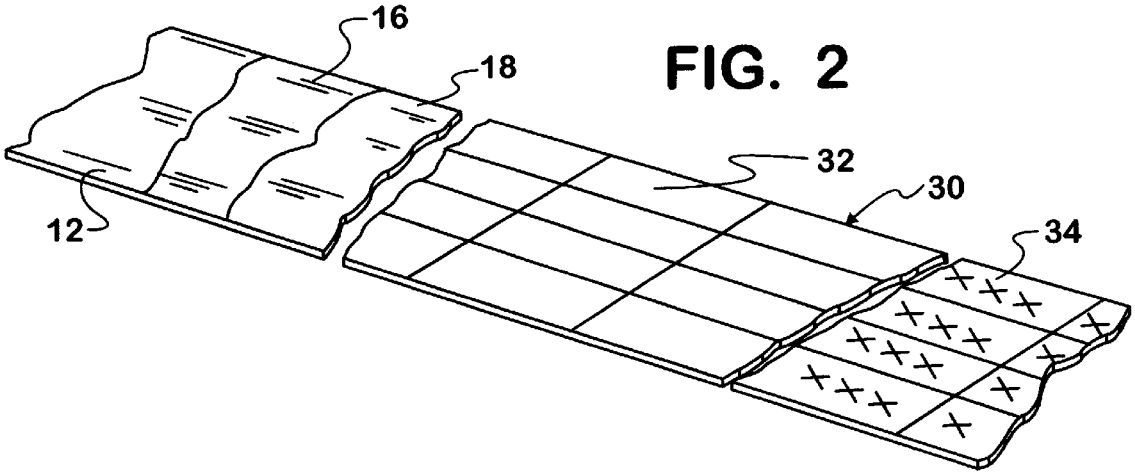
FIG. 2 is a conceptual schematic view of a web of paper labels showing how they go from the base paper web, are coated, are formed into rows and columns, and are printed, prior to separation into rolls or individuals labels for application.

Referring to FIG. 2, the label paper of, and made by, the present invention, including the first topside coating 16, of course, can be formed on a paper web 30 of a papermaking or paper coating machine and subsequently coated with the optional, but desired, backside and second topside coatings. As noted, usually the web will then be given some kind of calendering, either hot-soft or supercalendering to increase gloss. The web can carry plural columns of labels 32 (only one being designated numerically) and subsequently printed in a press with indicia (designated by the "x") into the label 34. The labels 34 are then separated, usually into rolls and then individualized and applied by machine to a glass object, such as a bottle. As shown in FIG. 3, the label could be anywhere on the bottle 40, such as the label 42 on the neck or the main label 44, as is conventional.

As noted in FIG. 1, the label would carry the printing on the upper surface of the second down topside coating, and would be coated with an adhesive 52 on the underside of, in this instance, the backside coating, for securing the label to the bottle. The adhesive of course could be applied either to the label or bottle or both. Preferably, the adhesive is water resistant and caustically dissolvable too so that the adhesive itself will not adhere to the bottle after the label is removed.

Afterwards, the bottle is filled, labeled, distributed, sold to a user and eventually returned by the user for recycling. The empty label bearing bottle is placed in a conventional caustic bottle washing solution (say 3% NaOH). The caustic solution can react with the coating 16 and dissolve the same, giving the caustic solution greater access to both the underside of coating 18 and the top of the paper base 12, to permit those to dissolve and also then release the adhesive from the bottle. As the completed label of the present invention is made of coated paper, and is not a film, it will have some porosity. Conventionally NaOH is used as a wash solution and most glass or bottle recycling installations are set up to use that material. Other basic solutions such as $NH_4OH$ are not desirable, thus seldom used, as ammonia fumes would be given off and they present more difficult environmental and health problems. As can be seen from FIG. 1, the vertical side perimeter of the label, including base 12 and top coat 16 bottom coat 14 provide paths for interaction with the caustic solution. However, this edge penetration is also assisted by penetration over the entire surface of the label due to the porous nature of the label. The porosity in the finished label is thus desired to promote removal of the label from the glass object in the caustic washing solution. The porosity provides additional pathways for the washing solution to penetrate through the label. A film-like structure on the other hand would not provide such pathways. As is noted above, the label of the method and apparatus of the present invention dissolves in a common NaOH washing solution in but a few minutes (3 or 4) and thus can be readily used in existing commercial bottle/glass recycling installations. The clean bottle can then be removed and reused. Further, the dissolved coating and paper base can be filtered from the caustic washing solution and the repulped paper recovered. The repulped paper can be put to a myriad of uses, e.g., again made into label paper, printing and writing paper, tissue paper, etc. The limitations in reuse would be consistent with the type of paper originally used; for example, free sheet (free of mechanical pulp) could be used for more purposes than would say paper made of or containing a high amount of mechanical pulp, as is known to persons in the paper arts.

While the preferred embodiment of the method and apparatus of the present invention have been disclosed and described, it should be understood that equivalent steps and elements will fall within the scope of the appended claims.

What is claimed is:

1. A method for making a water resistant caustically soluble aqueous paper coating to be applied to a top side of a paper label for a glass object recyclable in a caustic washing solution, comprising the steps of mixing with water:

(a) a binder made of at least 40% caustic-soluble material to provide dissolvability in the caustic washing solution, (b) a water repelling agent for adding water repellency to the coating, and (c) pigment including one or more of clay, $TiO_2$, calcium carbonate, and calcined clay, for providing opacity and brightness to the coating, to a solids level of at least 45%, whereby said paper label coating is water repellent but permits disintegration of the water repellent coating to permit the caustic washing solution to dissolve and repulp the coated paper label from the glass object.

2. A method as in claim 1, wherein said pigment includes a caustic soluble pigment and comprises adding said caustic soluble pigment to said water resistant caustically soluble coating to make up to 15 to 35% of the total weight of the pigment of said coating.

3. A method as in claim 2, comprising adding caustic soluble binder to reach 8% to 25% of the total weight of the pigment of said coating.

4. A method as in claim 2, wherein said caustic soluble binder includes one or more of resin and polymer material and comprises the step of adding one or more of said resin and polymer material to said top side coating.

5. A method as in claim 1, wherein said caustic soluble binder includes one or more of resin and polymer material and comprises the step of adding one or more of said resin and polymer material to said top side coating.

6. A method as in claim 1, comprising the step of adding water repelling agent to reach 2 to 4% of the total weight of said pigment of said coating.

7. A method as in claim 6, wherein said pigment includes a caustic soluble pigment and comprises adding caustic soluble pigment to reach 15 to 35% of the total weight of the pigment of said coating.

8. A method as in claim 7, comprising adding caustic soluble binder to reach 8% to 25% of the total weight of the pigment of said coating.

9. A method as in claim 1, wherein said water repelling agent includes alkyl ketene dimer, and comprises the step of adding alkyl ketene dimer to said coating.

10. The method of claim 9, comprising the step of adding alkyl ketene dimer until its about 2 to 4% of the weight of the total pigment of said coating.

11. The method in claim 1, comprising the step of adding pigment to achieve a solids level of about to 50% to 60%.

12. The method of claim 1, wherein said caustic soluble binder is Rhoplex I-2350 and comprising the step of adding Rhoplex I-2350 to make up at least 40% of the binder of said coating.

* * * * *